United States Patent [19]

Taki

[11] 3,973,877

[45] Aug. 10, 1976

[54] AUTOMATIC PUMPING DEVICE

[75] Inventor: Tomohiko Taki, Hitachi, Japan

[73] Assignee: Hitachi, Ltd., Japan

[22] Filed: Nov. 26, 1974

[21] Appl. No.: 527,229

[30] Foreign Application Priority Data

Nov. 30, 1973 Japan ..... 48-133506

[52] U.S. Cl. ..... 417/38

[51] Int. Cl.[2] ..... F04B 49/00

[58] Field of Search ..... 417/36, 38, 44; 137/568

[56] References Cited

UNITED STATES PATENTS

| | | | |
|---|---|---|---|
| 3,141,475 | 7/1964 | Guinard et al. | 417/44 |
| 3,150,684 | 9/1964 | Guinard et al. | 417/44 |
| 3,295,450 | 1/1967 | Schonwald et al. | 417/43 |
| 3,572,381 | 3/1971 | Nash | 417/44 |
| 3,739,810 | 6/1973 | Horan | 417/38 |
| 3,871,792 | 3/1975 | Gritz | 417/38 |
| 3,876,336 | 4/1975 | Nash | 417/38 |

*Primary Examiner*—William L. Freeh

*Attorney, Agent, or Firm*—Craig & Antonelli

[57] ABSTRACT

A pumping device of the type which is started and stopped by a pressure switch adapted to sense the internal pressure of a pressure tank mounted on the delivery side of a pump. A control valve adapted to open and close the inlet of the pressure tank is provided and operates such that the inlet of the pressure tank is closed when the flow rate of water is above the predetermined minimum level and opened when it is below the predetermined level, so as to apply the delivery pressure of the pump to the pressure tank and actuate the pressure switch. Thus, when the flow rate of water is above the minimum level, the inlet of the pressure tank is closed and no delivery pressure of the tank is applied to the interior of the pressure tank, so that the pressure switch remains inoperative. This keeps the pump from being started and stopped often even if the size of pressure tank is reduced. This type of automatic pumping device is employed as an attachment to water supply facilities for households.

8 Claims, 5 Drawing Figures

AUTOMATIC PUMPING DEVICE

BACKGROUND OF THE INVENTION

This invention relates to a pumping device of the type which is automatically started and stopped by means of a pressure switch adapted to sense the internal pressure of a pressure tank mounted on the delivery side of a pump, and more particularly it is concerned with an automatic pumping device of the type which is kept from being started and stopped often even if the size of the pressure tank for the pump is reduced.

Generally, an automatic pumping device comprises a pump, a pressure tank mounted on the delivery side of the pump for storing pumped-up water therein, and a pressure switch for automatically starting and stopping the pump by sensing an increase or decrease in the internal pressure of the pressure tank caused by the consumption of water. The pump is automatically started and stopped when a tap connected to the terminal end of the delivery system of the pump is opened and closed.

When the pump requires a pressure tank for automatically starting or terminating its operation, the capacity of the pressure tank for storing water under pressure therein tends to increase. This makes it necessary to increase the overall size of the pumping device including the pressure tank. Thus several proposals have hitherto been made to reduce the size of the pressure tank so as to obtain a compact overall size in an automatic pumping device.

In case the volume of water emitted and consumed through the tap is smaller than the volume of water delivered by the pump, the excess water corresponding to the difference between the volume of water emitted for consumption and the volume of water delivered by the pump would flow into the pressure tank and increase its internal pressure in a relatively short time interval when the size of the pressure tank is reduced. This would cause the pressure switch to sense an increase in the internal pressure of the pressure tank and stop the operation of the pump. Water would continue to flow through the tap even if the pump stops its operation, so that the internal pressure of the pressure tank would be quickly lowered. Upon the pressure being lowered to the level at which the pump is adapted to be started, the internal pressure of the pressure tank would be sensed by the pressure switch and the pump would be started again. Thus, if the volume of water consumed by opening the tap is small, the pump would be repeatedly started and stopped, causing changes to occur in the volume of water delivered by the pump. Thus automatic pumping devices of the prior art have the disadvantage of causing a damage to the pressure switch because it is often opened and closed when the pressure pump is reduced in size.

The aforementioned drawback of automatic pumps of the prior art having a pressure tank of the small size could be eliminated by providing a controller which, acting in response to the flow rate of water in the delivery system of the pump, opens and closes the inlet of the pressure switch which senses the pressure existing on the delivery side of the pump.

However, since the inlet of the pressure switch is opened and closed in this system by utilizing the rate of flow of water in the delivery system of the pump, it is impossible to increase the operation force with which the inlet of the pressure switch is opened and closed.

This has made it imperative to reduce the size of the inlet of the pressure switch to no larger than about 2 millimeters in diameter.

This has a disadvantage in that, when the tap connected to the end of the delivery system of the pump is suddenly opened wide to emit water therethrough, resistance of a high magnitude would be offered to the flow of water ejected from the pressure switch through the small inlet, making it impossible for the pressure of water in the pressure switch to be quickly brought to the level of the internal pressure of the pressure tank in slaved relation.

Thus, even if the internal pressure of the pressure tank (the pressure existing on the delivery side of the pump) is brought to the level at which the pump is adapted to be started or lowered below that level as a result of the tap being opened, the pressure in the pressure switch would be unable to reach the aforementioned level quickly. Thus the time at which the pressure in the pressure switch reaches the level at which the pump is adapted to be started would lag behind the time at which the internal pressure of the pressure tank reaches the level at which the pump is adapted to be started.

As a result, the trouble of the starting of the pump being delayed and the water emitted through the tap being interrupted would occur. Also, when means is provided to open and close the inlet of the pressure switch to control the starting and stopping of the pump as aforementioned, the inlet of the pressure tank would be subjected to the pressure in the delivery system of the pump at all times. Such pressure would be high when the pump is in operation, so that it would be necessary to impart high strength to the pressure tank by increasing the thickness of its wall.

Under these circumstances, difficulty has been encountered in providing an automatic pumping device of the small-size pressure tank type which can be of value in actual practice.

SUMMARY OF THE INVENTION

This invention has been made with a view to obviating the aforementioned disadvantages of the prior art and the disadvantages which would be caused when the size of the pressure tank is reduced.

Accordingly, a first object of the invention is to provide an automatic pumping device which can operate continuously regardless of changes in the volume of water consumed, so that the volume of water delivered by the pump per unit hour can be kept constant.

A second object of the invention is to provide an automatic pumping device which has a long service life.

A third object of the invention is to provide an automatic pumping device which can be controlled such that the pump can start and stop positively.

One of the features of the present invention lies in the provision of a control valve to accomplish the aforementioned objects, the control valve being adapted to close the inlet of the pressure tank after the pressure switch for controlling the starting and stopping of the pump is closed and the pump is started, and to open the inlet of the pressure tank before the pressure switch is opened and the pump is stopped. The provision of such control valve enables the pump to operate continuously, because the pressure applied to the pressure tank and the pressure switch is shut off from the pressure in the delivery system of the pump while the inlet of the pressure tank is kept closed by the control valve. Meanwhile the inlet of the pressure tank is opened before the pressure switch for controlling the starting and stopping of the pump is opened so as to introduce the pressure existing on the delivery side of the pump into the pressure tank and open the pressure switch, thereby interrupting the operation of the pump.

By controlling the opening and closing of the inlet of the pressure tank as aforementioned, it is possible to keep the pump from being started and stopped often, even if the volume of water delivered by the pump is greater than the volume of water emitted through the tap for consumption. Also, the high pressure existing on the delivery side of the pump when the pump is in operation is kept from being applied to the pressure tank while the inlet of the pressure tank is kept closed and the pump is operating. Because of this, the pressure tank is prevented from developing stress fatigue which would otherwise be caused by the application of high pressure.

Another feature is that the control valve adapted to open and close the inlet of the pressure tank is constructed as follows. The control valve according to the invention comprises a main body which is adapted to communicate with the delivery port of the pump, pressure tank and delivery system of the pump, and which is separated by two diagrams of different effective pressure receiving areas into an inlet chamber communicating with the delivery port of the pump and an outlet chamber communicating with the pressure tank and the delivery system of the pump. The diaphragms support, in the central portion, an orifice interconnecting the inlet chamber and the outlet chamber and a valve body which is adapted to close the inlet of the pressure tank, and define an intermediate chamber therebetween. Since the control valve is constructed as aforementioned, the valve body opens and closes the inlet of the pressure tank as each diaphragm is displaced. The control valve is made up of component parts which are free from failure even if used over a long interval of time, so that the inlet of the pressure tank can be positively opened and closed and the starting and stopping of the pump can be controlled positively.

Another feature of the invention lies in the fact that, when the inlet of the pressure tank is opened and closed by the control valve disposed in the delivery system of the pump, the inlet of the pressure tank is closed immediately after the pump is started and is opened immediately before the pump is started.

Another feature of the invention is that, when the inlet of the pressure tank is opened and closed by the control valve disposed in the delivery system of the pump, the inlet of the pressure tank is closed when the flow rate of water in the delivery system is above a predetermined minimum flow rate level and opened when it is below the predetermined minimum flow rate level. Because of this, the pressure applied to the pressure tank and the pressure switch can be shut off from the pressure in the delivery system of the pump so long as there is water flowing through the delivery system of the pump, no matter how small its volume may be, so that the pump can operate continuously. Meanwhile, when the water flowing through the delivery system of the pump is emitted through the tap or the flow rate is reduced below the predetermined minimum flow rate level, the inlet of the pressure tank is opened to permit the pressure existing on the delivery side of the pump to be introduced into the pressure tank whereby the pressure switch can be actuated to interrupt the operation of the pump. By opening and closing the inlet of the pressure pump in this way, the number of times the pump is started and stopped can be reduced, so that the pump can be kept from starting and stopping whenever the tap is opened and closed frequently.

Additional and other objects and features of the invention will become evident from the description of a preferred embodiment set forth hereinafter when considered in conjunction with the accompanying drawings.

DESCRIPTION OF A PREFERRED EMBODIMENT

Figure 1:
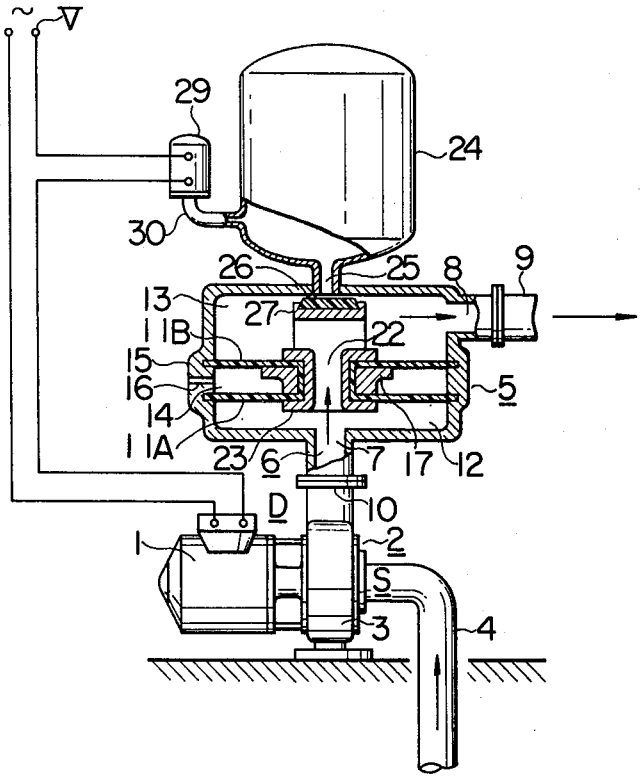
FIG. 1 is a sectional view of the automatic pump comprising one embodiment of the invention.

A preferred embodiment of the invention will now be described with reference to FIG. 1 to FIG. 5. The automatic pumping device comprising one embodiment of the invention is shown in FIG. 1 in which a pump 2 is driven by an electric motor 1 connected to a power source V.

The pump 2 includes a casing 3 in which is housed an impeller (not shown) connected to a rotary shaft (not shown) of the electric motor. In this embodiment, the pump 2 is a centrifugal pump.

A suction pipe 4 is connected at one end to a suction side S of the pump 2 while it is immersed in water in a well at the other end.

A control valve 5 is mounted on the delivery side D of the pump 2. More specifically, the control valve 5 is disposed in the delivery system 6 of the pump 2 and includes a main body of the cylindrical shape which is formed therein with a main inlet port 7 and a main outlet port 8. Preferably the main inlet port 7 is disposed in the center of the bottom of the cylindrical main body and the main outlet port 8 is formed in an upper portion of a side wall 15 of the main body. A delivery pipe 9 forming a part of the delivery system 6 is connected at one end to the main outlet port 8 and has mounted at the other end a tap or taps (not shown) through which water delivered by the pump 2 is discharged. The main inlet port 7 is connected to a delivery port 10 of the pump 2.

Diaphragms 11A and 11B substantially parallel to each other are mounted in the main body of the control valve 5 and divide the main body into an inlet chamber 12 disposed on the side of the main inlet port 7 and an outlet chamber 13 disposed on the side of the main outlet port 8. The diaphragms 11A and 11B are connected together in the center and form a unit. However, the diaphragms 11A and 11B may be formed independently of each other. Formed between the diaphragm 11A facing the inlet chamber 12 and the diaphragm 11B facing the outlet chamber 13 is an intermediate chamber 14 which is maintained in communication with atmosphere through a small port 16 formed in the side wall 15 of the main body of the control valve 5.

Figure 4:
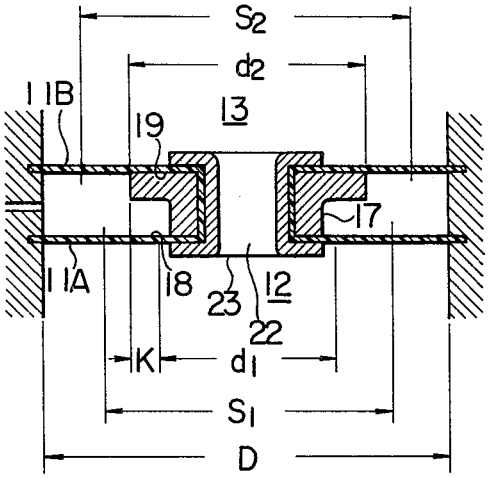
FIG. 4 is a fragmentary sectional view, on an enlarged scale, of the control valve shown in FIG. 1.

A separate piece 17 is held between the diaphragms 11A and 11B and disposed in the center thereof. As shown in FIG. 4, the separate piece 17 is formed such that opposite end portions thereof differ from each other in diameter as indicated by K. This point will be described more in detail with reference to FIG. 4. The separate piece 17 has a receiving surface 18 in contact with the inner surface of one diaphragm 11A. An end portion of the separate piece 17 having the receiving surface 18 has an outer diameter d1 which is smaller than the outer diameter d2 of an end portion of the separate piece 17 having a receiving surface 19 maintained in contact with the inner surface of the other diaphragm 11B.

In this construction, the effective pressure receiving area S of the diaphragm is generally given by the following formula:

$$S = \frac{\pi}{4}\left(\frac{D+d}{2}\right)^2 \quad (1)$$

where $D$ is the outer diameter of the diaphragm, and d is the inner diameter of the diaphragm.

From the formula (1), the effective pressure receiving area S1 of a pressure receiving portion 20 of the diaphragm 11A can be expressed as follows:

$$S_1 = \frac{\pi}{4}\left(\frac{D+d_1}{2}\right)^2 \quad (2)$$

wherein $d1$ is the outer diameter of the end portion of the separate piece 17 having the receiving surface 18.

On the other hand, the effective pressure receiving area S2 of a pressure receiving portion 21 of the diaphragm 11B facing the outlet chamber 13 can be expressed as follows from the formula (2):

$$S_2 = \frac{\pi}{4}\left(\frac{D+d_2}{2}\right)^2 \quad (3)$$

where $d2$ is the outer diameter of the end portion of the separate piece having the receiving surface 19.

In this case, the effective pressure receiving area S1 of the diaphragm 11A is set at a level lower than the level of the effective pressure receiving area S2 of the diaphragm 11B facing the outlet chamber 13.

A water passageway 22 is formed in the center of the diaphragms 11A and 11B and maintains communication between the inlet chamber 12 and the outlet chamber 13 facing the diaphragms 11A and 11B respectively. An orifice 23 held by the diaphragms 11A and 11B is disposed in the water passageway 22. This orifice 23 is of the fixed type, but it may be a variable orifice.

Referring to FIG. 1 again, a pressure tank 24 which is of the small type and low in capacity is formed with an inlet 25 which faces the outlet chamber 13 of the control valve 5 and communicating therewith through an opening formed in the main body to maintain the pressure tank 24 in communication with the outlet chamber 13. Preferably the inlet 25, orifice 23 and main inlet port 7 are in alignment with one another. A valve seat 26 is formed on a portion of the inner wall of the outlet chamber 13 which faces the inlet 25 of the pressure tank 24. A valve body 27 is connected to the separate piece 17 and adapted to move in response to the displacements of the diaphragms 11A and 11B to open and close the inlet 25 of the pressure tank 24. A valve cushion 28 is attached to the front end of the valve body 27. As the valve body 27 moves in the direction of an arrow F (See FIG. 2 and FIG. 3) in response to the displacements of the diaphragms 11A and 11B, the valve cushion 28 is brought into engagement with the valve seat 26 to close the inlet 25 of the pressure tank 24.

Referring to FIG. 1 again, a pressure switch 29 which is known is connected to the pressure tank 24 through a pressure conduit 30. Although its internal mechanism is not shown, the pressure switch 29 is adapted to sense the internal pressure of the pressure tank 24 to control the starting and stopping of the electric motor 1 for driving the pump 2. Thus the starting and stopping of the pump 2 can be controlled by the pressure switch 29.

The pressure switch 29 is closed to start the pump 2 when it senses that the internal pressure of the pressure tank 24 has reached the level at which the pump is adapted to be started. Meanwhile when the pressure switch 29 senses that the internal pressure of the pressure tank 24 has reached the level at which the pump is adapted to be stopped, it is opened to interrupt the operation of the pump 2.

Figure 3:
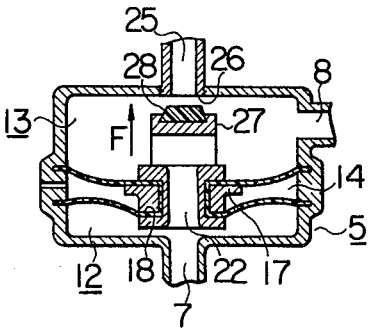

The operation of the control valve 5 will now be described. If no current is passed from the power source V to the electric motor 1, then the diaphragms 11A and 11B are balanced without deviating in any direction. When this is the case, the valve body 27 is spaced apart from the valve seat 26 a small distance, so that the inlet 25 of the pressure tank 24 is slightly open. If a current is passed to the electric motor 1 while the tap connected to the end of the delivery pipe 9 connected to the main outlet port 8 of the control valve 5 remains closed, then the internal pressure of the pump 2 is applied to the control valve 5, with a result that the pressure in the inlet chamber 12 and the outlet chamber 13 rises and acts on the diaphragms 11A and 11B. Since the effective pressure receiving area S1 of the diaphragm 11A facing the inlet chamber 12 is smaller than the pressure receiving area S2 of the diaphragm 11B facing the outlet chamber 13 as aforementioned, the force exerted on the diaphragm 11B facing the outlet chamber 13 is greater than that exerted on the diaphragm 11A facing the inlet chamber 12 due to the difference in the pressure receiving area, when the internal pressure of the pump 2 is applied to the control valve 5. Accordingly, the diaphragms 11A and 11B move toward the main inlet port 7 as shown in FIG. 3 due to the difference in the forces exerted on the diaphragms.

When this is the case, the valve body 26 moves toward the main inlet port 7 in response to the displacement of the diaphragms 11A and 11B, thereby fully opening the inlet 25 of the pressure tank 24 facing the outlet chamber 13 of the control valve 15. This permits the delivery pressure of the pump 2 to be applied to the interior of the pressure tank 24, so that the pressure switch 29 is opened and the operation of the pump 2 is interrupted.

Upon any one of the taps connected to the end of the delivery pipe 9 being opened to discharge water, the water present in the delivery pipe 9 and the pressure tank 24 is discharged. At the same time, there occurs a reduction in the internal pressure of the pressure tank 24. As the internal pressure of the pressure tank 24 reaches the level at which the pump 2 is adapted to be started, the pressure is sensed by the pressure switch 29 and the switch 29 is closed. Upon the pressure switch 29 being closed, the pump 2 is immediately started and the water delivered by the pump 2 flows into the control valve 5 through the main inlet port 7 thereof. The water under pressure is introduced into the inlet chamber 12 from which it passes through the water passageway 22 into the outlet chamber 13. At the same time, the water under pressure moves toward the main outlet port 8 and moves therethrough into the delivery pipe 9 to be discharged through the tap at the end of the pipe 9.

When the water under pressure flowing into the control valve 5 passes through the orifice 23 in the water passageway 22 of the control valve 5, resistance is offered to the flowing water by the orifice, so that differential pressure is produced between the inlet chamber 12 and the outlet chamber 13.

Figure 2:
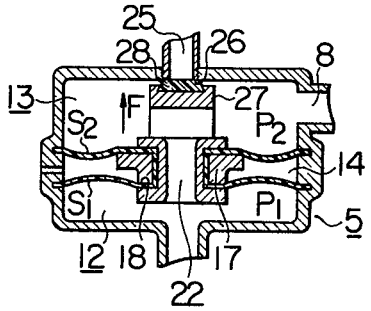
FIG. 2 and FIG. 3 are views in explanation of the operation of the control valve shown in FIG. 1.

As a result, the pressure P1 in the inlet chambr 12 becomes higher than the pressure P2 in the outlet chamber 13 (See FIG. 2). Combined with the pressure applied by the water flowing into the inlet chamber 12 and applied to the diaphragm 11A, the differential pressure produces a change in the balance of forces exerted on the diaphragms 11A and 11B, so that the diaphragms 11A and 11B are displaced toward the outlet chamber 13 as shown in FIG. 3.

The valve body 27 which moves in response to the displacement of the diaphragms moves toward the inlet 25 of the pressure tank 24 and closes the same. This keeps the internal pressure of the pressure tank 24 at or slightly higher than the level at which the pump is adapted to be started. When this is the case, the internal pressure of the pressure tank 24 is shut off from the pressure existing on the delivery side of the pump 2 even if the internal pressure in the delivery system of the pump 2 rises, since the inlet 25 of the pressure tank 24 is closed.

If the degree of opening of the tap is reduced to decrease the volume of water discharged therethrough, then the rate of flow of the water under pressure flowing into the inlet chamber 12 of the control valve 5 is lowered. At the same time, the resistance offered by the orifice to the movement of water passing therethrough is also lowered, so that a change is caused to occur in the relation between the forces exerted on the diaphragms 11A and 11B. However, since the pressure existing on the delivery side D of the pump 2 increases as the volume of water discharged through the tap is reduced, the pressure differential between the interior of the control valve 5 and the interior of the pressure tank 24 becomes greater. Because of this, the valve body 27 tending to return to its original position as shown in FIG. 3 in response to the displacement of the diaphragms 11A and 11B is kept from returning to its original position because the valve body 27 is forced by the pressure differential against the valve seat 26, thereby keeping the inlet 25 of the pressure tank 24 closed.

If the tap is closed or nearly closed, then there is substantially no water flowing from the inlet chamber 12 through the orifice 23 into the outlet chamber 13. This eliminates the pressure differential between the inlet chamber 12 and the outlet chamber 13 which is caused to occur by the resistance offered by the orifice to the moving water, with a result that the pressure in the inlet chamber 12 becomes substantially equal to the pressure in the outlet chamber 13. Meanwhile the pressure existing on the delivery side of the pump 2 steadily increases, so that the pressure in the control valve 5 rises and substantially uniform high pressure is applied to the diaphragms 11A and 11B.

As aforementioned, the effective pressure receiving areas S1 and S2 of the diaphragms 11A and 11B facing the inlet chamber 12 and the outlet chamber 13 respectively of the control valve 5 are in the relation $S2 > S1$, this difference in the pressure receiving area increases the force which moves the diaphragms 11A and 11B toward the inlet chamber 12 in which the main inlet port 7 is disposed. If this force becomes greater than the force exerted by the differential pressure applied to the valve body 27 to keep the same in the position shown in FIG. 2, then the diaphragms 11A and 11B are displaced toward the inlet chamber 12 and the valve body 27 is released from engagement with the valve seat 26 to thereby open the inlet 25 of the pressure tank 24. Thereafter, the water under pressure in the control valve 5 and the delivery system 6 flows into the pressure tank 24 through the inlet 25.

The internal pressure of the pressure tank 24 rises as the water under high pressure flows thereinto. When the internal pressure of the pressure tank 24 reaches the level at which the operation of the pump 2 is adapted to be interrupted, the pressure switch 29 senses it and is opened. The pump 2 stops simultaneously as the pressure switch 29 is opened. At this time, the valve body 27 has been restored to the position shown in FIG. 3. If the tap is opened again, then the aforementioned process is repeated and the pump 2 operates.

As aforementioned, the control valve 5 functions such that it closes the inlet 25 of the pressure tank 24 after the pressure switch 29 is closed or the pump 2 is started following the closure of the pressure switch 29, and thereafter it keeps the pressure in the delivery system 6 from being applied to the interior of the pressure tank 24. Moreover, the inlet 25 of the pressure tank 24 remains closed till the volume of water discharged through the tap or the volume of water passing through the orifice 23 is reduced below the level of the minimum flow rate. Accordingly, if the flow rate of water moving through the delivery system 6 of the pump 2 is above the minimum flow rate, then the pump continues its operation without interruption and never operates intermittently. The minimum flow rate refers to a flow rate of water which exists when the force acting on the diaphragms 11A and the valve body 27 to move the valve body 27 downwardly the force including the pressure of water in the outlet chamber 13 acting on the diaphragm 11A, the internal pressure of the pressure tank 24 acting on the valve body 27 and the weight of the diaphragm and orifice is greater than the force acting to maintain the valve body 27 in the position shown in FIG. 2 which includes the pressure of water in the inlet chamber 12 acting on the diaphragm 11B and the pressure of water in the outlet chamber 13 acting on the valve body 27. The minimum flow rate may vary depending on the inner diameter of the orifice 23, the roughness of the inner surface of the orifice 23, the effective pressure receiving areas S1 and S2 of the diaphragms 11A and 11B and the weight of the portion held by the diaphragms. It will be appreciated that the minimum flow rate can be set at a desired level by suitably designing the orifice 23, diaphragms 11A and 11B and separate piece 17. It is possible to reduce the minimum flow rate to a relatively low level or 2 liters per minute, for example.

If the flow rate of water in the delivery system 6 of the pump 2 is reduced below the minimum flow rate, then the diaphragms 11A and 11B move downwardly together with the valve body 27 and the inlet 25 of the pressure tank 24 is opened. The high pressure in the outlet chamber 13 is applied to the interior of the pressure tank 24, so that the operation of the pump 2 is immediately interrupted by the pressure switch 29 which senses an increase in the internal pressure of the pressure tank 24.

Accordingly, even if the pump operates such that the volume of water emitted through the tap per unit hour is smaller than the volume of water delivered by the pump, the pump 2 continues its operation regardless of changes in the volume of water discharged through the tap, because the internal pressure of the pressure tank 24 is shut off by the control valve 5 from the pressure in the delivery system 6 as described hereinabove.

Figure 5:
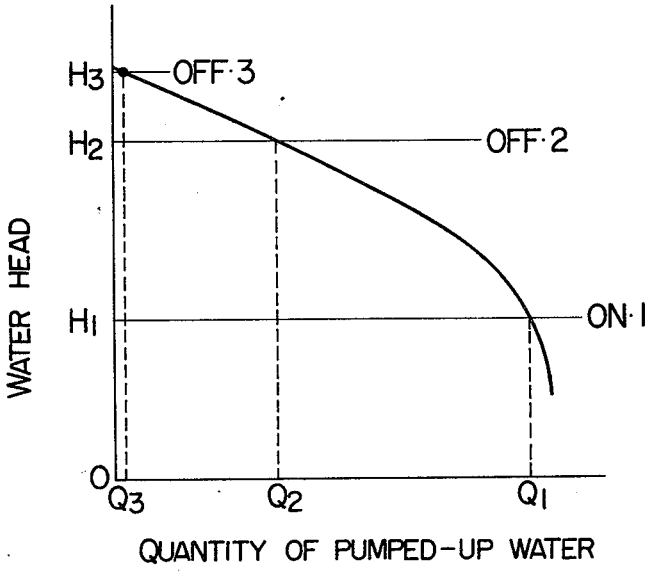
FIG. 5 is a graph showing the pumping characteristics of an automatic pumping device.

FIG. 5 shows a pumping curve. Let us assume that the pressure switch 29 used is such that it is closed at a head H1 to start the pump 2 and is opened at a head H2 to stop the same. In a device of the prior art having no control valve according to the invention, the pump will be started when the internal pressure of the pressure tank 24 (or the pressure in the delivery port of the pump) is H1 and stopped when the pressure is H2. Thus the pump will operate such that the quantity of pumped-up water is in a range between Q1 and Q2 or the operation begins at a starting point ON 1 and terminates at a stopping point OFF 2.

On the other hand, in a pump in which the present invention is incorporated, it is possible to set a minimum flow rate at a value which is in the vicinity of the cut-off operation of the pump 2. If the minimum flow rate is set at Q3, it is possible to continue the operation of the pump 2 without interruption till the quantity of pumped-up water reaches Q3, and the pump 2 terminates its operation at a stopping point OFF 3. By means of the invention, it is thus possible to increase the range of operation of the pump according to the invention which is from ON 1 to OFF 3 over and above the range of operation of the conventional pump which is from ON 1 to OFF 2. Accordingly, the pump 2 continuously operates without interruption and the pressure switch 29 is not opened or closed while the pump 2 is operating in this range as aforementioned. This eliminates changes in the volume of water delivered by the pump per unit hour which would otherwise be caused to occur by the intermittent operation of the pump. That is, the volume of water discharged through the tap per unit hour can be kept constant.

Thus, the invention provides an automatic pumping device which can operate continuously regardless of changes in the volume of water emitted through the tap and which permits the volume of water delivered per unit hour to be kept constant, even if the pressure tank employed is reduced in size.

According to the invention, the starting and stopping of the pump 2 is controlled by controlling the opening and closing of the inlet 25 of the pressure tank 24 by means of the control valve 5. By virtue of this feature, the high pressure in the delivery system 6 of the pump 2 is kept from being applied to the interior of the pressure tank 24 particularly when the pump is in operation. This is conducive to longer service life of the pump, because the pressure tank 24 is kept from developing stress fatigue which would otherwise be caused by the effect of the high pressure existing in the delivery system 6 of the pump 2.

Moreover, the control valve 5 functions such that it closes the inlet 25 of the pressure tank 24 immediately after the pressure switch 29 is closed and the pump 2 is started. This keeps the inlet 25 of the pressure tank 24 closed while the pump 2 is in operation, with the internal pressure of the pressure tank 24 being maintained at all times near the level at which the pump is adapted to be started. Because of this, a rise in the internal pressure of the pressure pump 24 to the level at which the pressure switch 29 is closed or the level at which the pump 2 is adapted to be started has a time lag behind the closing of the tap to stop the emission of water. Accordingly, the pump 2 is not started and stopped often even if the tap is opened and closed often. Thus a reduction in the size or capacity of the pressure tank does not result in a reduction in the functioning of the pressure tank, so that the practical value of the pump having a pressure tank of the small size can be increased.

The control valve 5 for effecting control of operation of the pump 2 is constructed such that the diaphragms mounted in the control valve 5 have different effective pressure receiving areas, and an orifice is provided in the water passageway for maintaining communication between the inlet chamber and the outlet chamber defined by the diaphragms in the control valve 5, so that the force with which the inlet 25 of the pressure tank 24 is opened and closed can be obtained by virtue of the aforementioned construction of the control valve. This eliminates the need to use, for opening and closing the inlet of the pressure tank, a spring or other resilient means whose resilience tends to undergo a change after prolonged use.

Thus, when the control valve according to the invention is used for opening and closing the inlet of the pressure tank, there is no change in the force with which the inlet of the pressure tank is opened and closed, even if the control valve is used over a long period of time. This enables control of starting and stopping of the pump to be positively effected.

While a particular embodiment of this invention has been shown and described above, it will be understood, of course, that the invention is not to be limited thereto, since many modifications may be made, and it is contemplated therefore, by the appended claims, to cover any such modifications as fall within the spirit and scope of this invention.

I claim:

1. An automatic pumping device comprising:

a. a pump;

b. a pressure tank maintained in communication with a delivery system of said pump;

c. a pressure switch adapted to sense the internal pressure of said pressure tank and to effect control of starting and stopping of said pump; and d. a control valve mounted in the delivery system of said pump for effecting control of opening and closing of an inlet of said pressure tank, said control valve being adapted to close said inlet when the flow rate of water in the delivery system is above a predetermined minimum flow rate level and to open said inlet when the flow rate of water in the delivery system is below said predetermined minimum flow rate level, said control valve comprises a main body formed therein with a main inlet port, a main outlet port and an opening communicating with the inlet of said pressure tank, said main inlet port communicating with a delivery port of the pump while said main outlet communicates with a delivery system, diaphragms mounted in said main body and disposed substantially parallel to each other to divide the interior of said main body into an inlet chamber in which said main inlet port is formed and an outlet chamber in which said main outlet port is formed, said diaphragms defining therebetween an intermediate chamber, one of said diaphragms facing said outlet chamber having an effective pressure receiving area which is greater than the effective pressure receiving area of the other diaphragm facing said inlet chamber, an orifice held by said diaphragms for maintaining said inlet chamber and said outlet chamber in communication with each other, and a valve body held by said orifice adapted to open and close the inlet of the pressure tank.

2. An automatic pump as claimed in claim 1, wherein said intermediate chamber is maintained in communication with atmosphere.

3. An automatic pump as claimed in claim 1, wherein said main body is cylindrical in shape and said main inlet port, said orifice and said inlet of said pressure tank are disposed in alignment with one another along the center line of said main body.

4. An automatic pump as claimed in claim 1, further comprising a separate piece interposed between said parallel diaphragms, said separate piece being maintained in contact with the diaphragms and surrounding said orifice, a portion of said separate piece maintained in contact with the diaphragm facing said outlet chamber is greater in area than a portion thereof maintained in contact with the diaphragm facing said inlet chamber.

5. An automatic pumping device comprising:

a. a pump;

b. a pressure tank maintained in communication with a delivery system of said pump;

c. a pressure switch means for sensing the internal pressure of said pressure tank and for effecting control of starting and stopping of said pump; and d. a control valve means mounted in the delivery system of said pump for closing an inlet of said pressure tank after said pressure switch means is closed and for opening said inlet of said pressure tank before said pressure switch is opened, said control valve means comprising a main body portion formed with a main inlet port, a main outlet port and an opening communicating with the inlet of said pressure tank, said main inlet port communicating with a delivery port of the pump while said main outlet communicates with the delivery system, diaphragm means mounted in said main body and disposed substantially parallel to each other to divide the interior of said main body into an inlet chamber in which said main inlet port is formed and an outlet chamber in which said main outlet port is formed, said diaphragm means defining therebetween an intermediate chamber, one of said diaphragm means facing said outlet chamber having an effective pressure receiving area which is greater than the effective pressure receiving area of the other diaphragm facing said inlet chamber, an orifice means supported by said diaphragm means for maintaining said inlet chamber and said outlet chamber in communication with each other, and a valve body means supported by said orifice for opening and closing the inlet of the pressure tank.

6. An automatic pump according to claim 5, wherein means are provided for communicating said intermediate chamber with the atmosphere.

7. An automatic pump according to claim 5, wherein said main body is cylindrical and said main inlet port, said orifice means and the inlet of said pressure tank are disposed in alignment with one another along the center line of said main body.

8. An automatic pump according to claim 5, further comprising a separate piece interposed between said parallel diaphragms, said separate piece interposed between said parallel diaphragm means, said separate piece being maintained in contact with the diaphragm means and surrounding said orifice, a portion of said separate piece maintained in contact with the diaphragm means facing said outlet chamber being greater in area than a portion thereof maintained in contact with the diaphragm means facing said inlet chamber.

* * * * *